US011585635B2

(12) United States Patent
Moore et al.

(10) Patent No.: US 11,585,635 B2
(45) Date of Patent: Feb. 21, 2023

(54) FIREARM STORAGE AND SAFETY DEVICE

(71) Applicants: Michael Moore, Opelika, AL (US); Anthony Sparks, Bessemer, AL (US)

(72) Inventors: Michael Moore, Opelika, AL (US); Anthony Sparks, Bessemer, AL (US)

( * ) Notice: Subject to any disclaimer, the term of this patent is extended or adjusted under 35 U.S.C. 154(b) by 172 days.

(21) Appl. No.: 17/139,624

(22) Filed: Dec. 31, 2020

(65) Prior Publication Data

US 2022/0205757 A1 Jun. 30, 2022

(51) Int. Cl.

| | |
|---|---|
| ***F41A 23/18*** | (2006.01) |
| ***F41C 33/06*** | (2006.01) |
| ***F41C 33/04*** | (2006.01) |
| ***A47G 25/14*** | (2006.01) |

(52) U.S. Cl.

CPC ..... *F41C 33/06* (2013.01); *A47G 25/14* (2013.01); *F41A 23/18* (2013.01); *F41C 33/04* (2013.01)

(58) Field of Classification Search

CPC ..... F41A 23/18; F41C 33/04; F41C 33/06

See application file for complete search history.

(56) References Cited

U.S. PATENT DOCUMENTS

| | | | | | |
|---|---|---|---|---|---|
| 3,468,508 | A * | 9/1969 | Huver | A47B 81/005 | 248/314 |
| 3,910,442 | A * | 10/1975 | Gargano | B65D 41/06 | 215/221 |
| D239,041 | S * | 3/1976 | Rubinstein | D6/318 | |
| 4,620,651 | A * | 11/1986 | Spies | A47G 25/14 | D6/315 |
| 4,688,023 | A * | 8/1987 | McGill | G08B 21/18 | 292/87 |
| 5,451,023 | A * | 9/1995 | Johnston | F41A 23/18 | 248/300 |
| 5,480,077 | A * | 1/1996 | Eng | F41C 33/0227 | D3/223 |
| 5,704,152 | A * | 1/1998 | Harrison | F41A 17/04 | 42/70.07 |
| D633,978 | S | 3/2011 | Vande Noord | | |
| 8,602,275 | B1 * | 12/2013 | Kiger | F41C 33/0263 | 224/238 |
| 8,807,404 | B1 * | 8/2014 | Howell | F41C 33/0227 | 224/242 |
| 9,345,322 | B1 * | 5/2016 | Starnes | A47G 25/14 | |
| 9,786,258 | B2 * | 10/2017 | Keller | G10G 5/00 | |
| D820,616 | S | 6/2018 | Nussbaum | | |
| 10,048,032 | B1 * | 8/2018 | Lazar | F41A 17/44 | |
| 10,070,746 | B1 * | 9/2018 | Cavazos | A47G 25/14 | |
| 2001/0032406 | A1 * | 10/2001 | Yirmiyahu | F41C 33/0263 | 24/3.9 |

(Continued)

FOREIGN PATENT DOCUMENTS

| | | |
|---|---|---|
| WO | WO8800324 | 1/1988 |

*Primary Examiner* — Derrick R Morgan

(57) ABSTRACT

A firearm storage and safety device for securing and hiding a firearm includes a clothes hanger and a holster. The clothes hanger comprises a hook and a panel. The hook is engaged to and extends from an upper edge of the panel equally distant from opposed sides thereof. The hook can engage a clothes rod to hang the clothes hanger. The holster is engaged to a respective opposed face of the panel. A firearm can be inserted into the holster so that the firearm is engaged to the panel. An article of clothing, such as a coat or a jacket, can be hung from the clothes hanger to conceal the firearm.

11 Claims, 6 Drawing Sheets

(56) References Cited

U.S. PATENT DOCUMENTS

| | | | | |
|---|---|---|---|---|
| 2005/0045640 | A1* | 3/2005 | Waring | A47L 13/51 220/500 |
| 2007/0145091 | A1* | 6/2007 | Meesey | F41A 23/18 224/637 |
| 2011/0272539 | A1* | 11/2011 | Yagi | F41C 33/04 248/220.21 |
| 2012/0061432 | A1* | 3/2012 | Novak | F41C 33/04 224/243 |
| 2012/0152776 | A1* | 6/2012 | Camp | F41C 33/0263 206/317 |
| 2014/0197212 | A1* | 7/2014 | Huffaker | A47G 25/16 223/85 |
| 2014/0263497 | A1* | 9/2014 | Visalli | F41C 33/0227 42/70.11 |
| 2018/0017355 | A1* | 1/2018 | Feris | E05B 69/006 |
| 2018/0110333 | A1* | 4/2018 | Chavira | F41C 33/06 |
| 2018/0128572 | A1* | 5/2018 | Carter | F41C 33/06 |
| 2020/0039694 | A1* | 2/2020 | Feris | E05B 69/006 |

* cited by examiner

FIREARM STORAGE AND SAFETY DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to firearm storage devices and more particularly pertains to a new firearm storage device for securing and hiding a firearm. The present invention discloses a clothes hanger having an integral holster for stowing a firearm, and over which an article of clothing can be positioned for concealing the firearm.

(2) Description of Related Art Including Information Disclosed Under 37 CFR 1.97 and 1.98

The prior art relates to firearm storage devices, which may comprise pipes engageable to barrels of firearms and having hooks for hanging, clothes hangers having means for engaging trigger assemblies of firearms, and hanging containers in which firearms can be stowed. What is lacking in the prior art is a clothes hanger having an integral holster for stowing a firearm, and over which an article of clothing can be positioned for concealing the firearm.

BRIEF SUMMARY OF THE INVENTION

An embodiment of the disclosure meets the needs presented above by generally comprising a clothes hanger and a holster. The clothes hanger comprises a hook and a panel. The hook is engaged to and extends from an upper edge of the panel equally distant from opposed sides thereof. The hook is configured to engage a clothes rod to hang the clothes hanger. The holster is engaged to a respective opposed face of the panel and is configured for insertion of a firearm so that the firearm is engaged to the panel. The clothes hanger is configured to have an article of clothing, such as a coat or a jacket, hung thereupon to conceal the firearm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
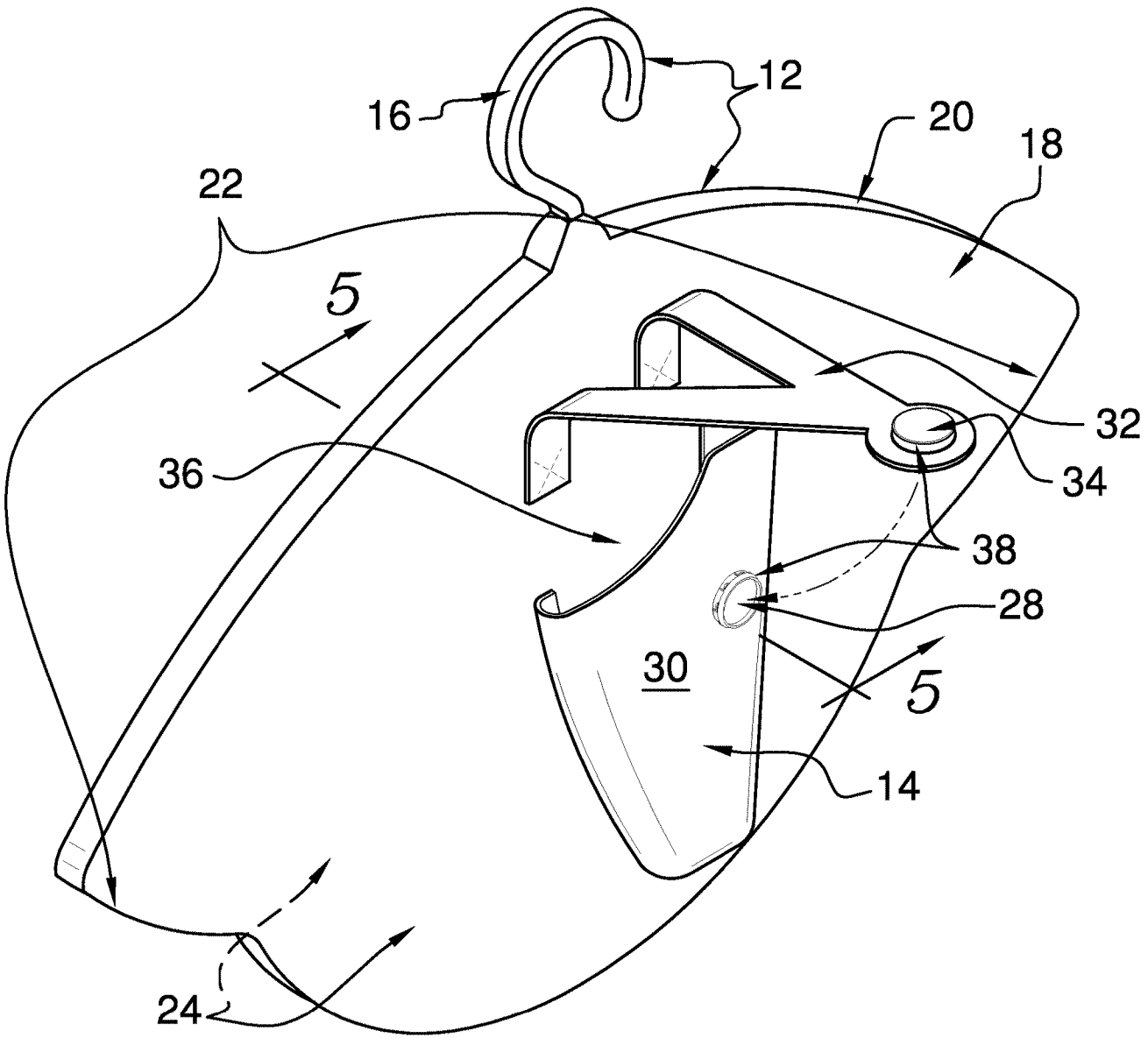
FIG. 1 is an isometric perspective view of a firearm storage and safety device according to an embodiment of the disclosure.

With reference now to the drawings, and in particular to FIGS. 1 through 6 thereof, a new firearm storage device embodying the principles and concepts of an embodiment of the disclosure and generally designated by the reference numeral 10 will be described.

As best illustrated in FIGS. 1 through 6, the firearm storage and safety device 10 generally comprises a clothes hanger 12 and a holster 14. The clothes hanger 12 comprises a hook 16 and a panel 18. The hook 16 is engaged to and extends from an upper edge 20 of the panel 18 equally distant from opposed sides 22 thereof. The hook 16 is configured to engage a clothes rod to hang the clothes hanger 12. The upper edge 20 of the panel 12 is arcuate, such that the upper edge 20 tapers downwardly from the hook 16 to the opposed sides 22 of the panel 18. The clothes hanger 12 thus is configured for hanging of a jacket or coat. The panel 18 is substantially rigid and may comprises elastomer, or other substantially rigid material, such as, but not limited to, wood, bamboo, metal, and the like. The panel 18 may comprise acrylic-polyvinyl chloride.

Figure 4:
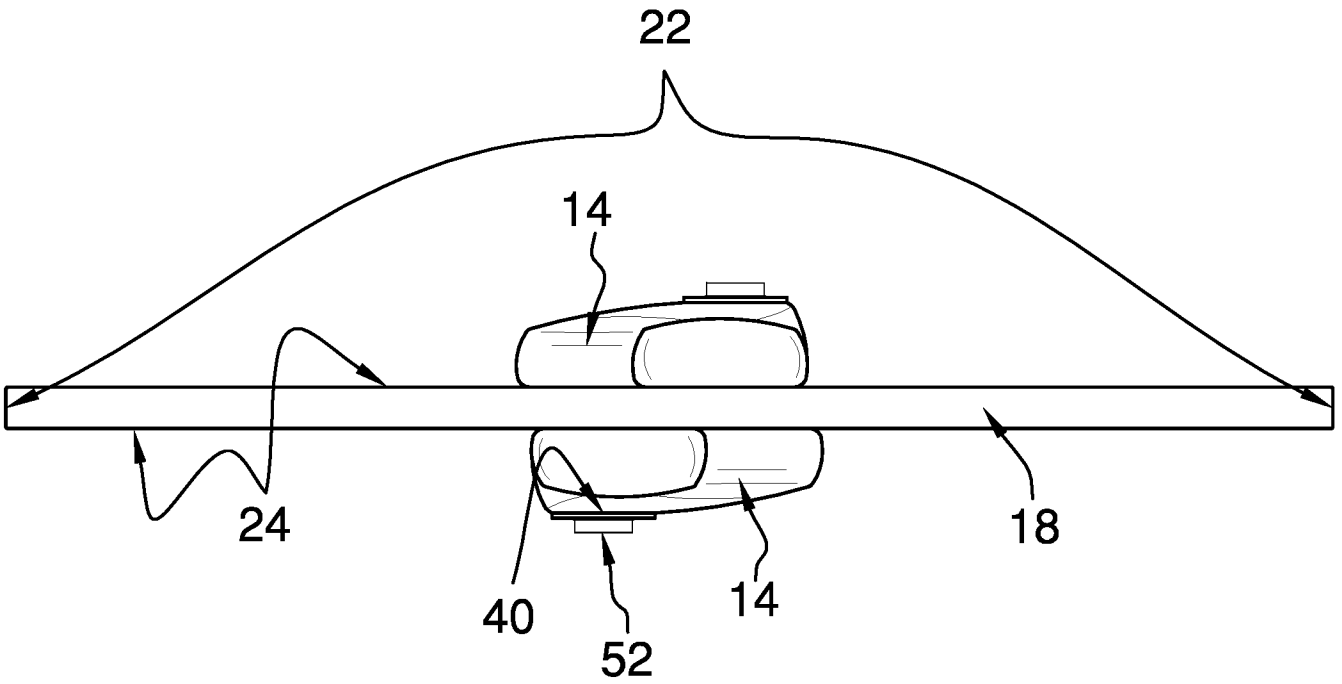
FIG. 4 is a bottom view of an embodiment of the disclosure.

The holster 14 is engaged to a respective opposed face 24 of the panel 18 and is configured for insertion of a firearm so that the firearm is engaged to the panel 18. The clothes hanger 12 is configured to have an article of clothing, such as a coat or a jacket, hung thereupon to conceal the firearm. The holster 14 may be one of a pair of holsters 14 positioned singly on the opposed faces 24 of the panel 18, as shown in FIG. 4.

Figure 2:
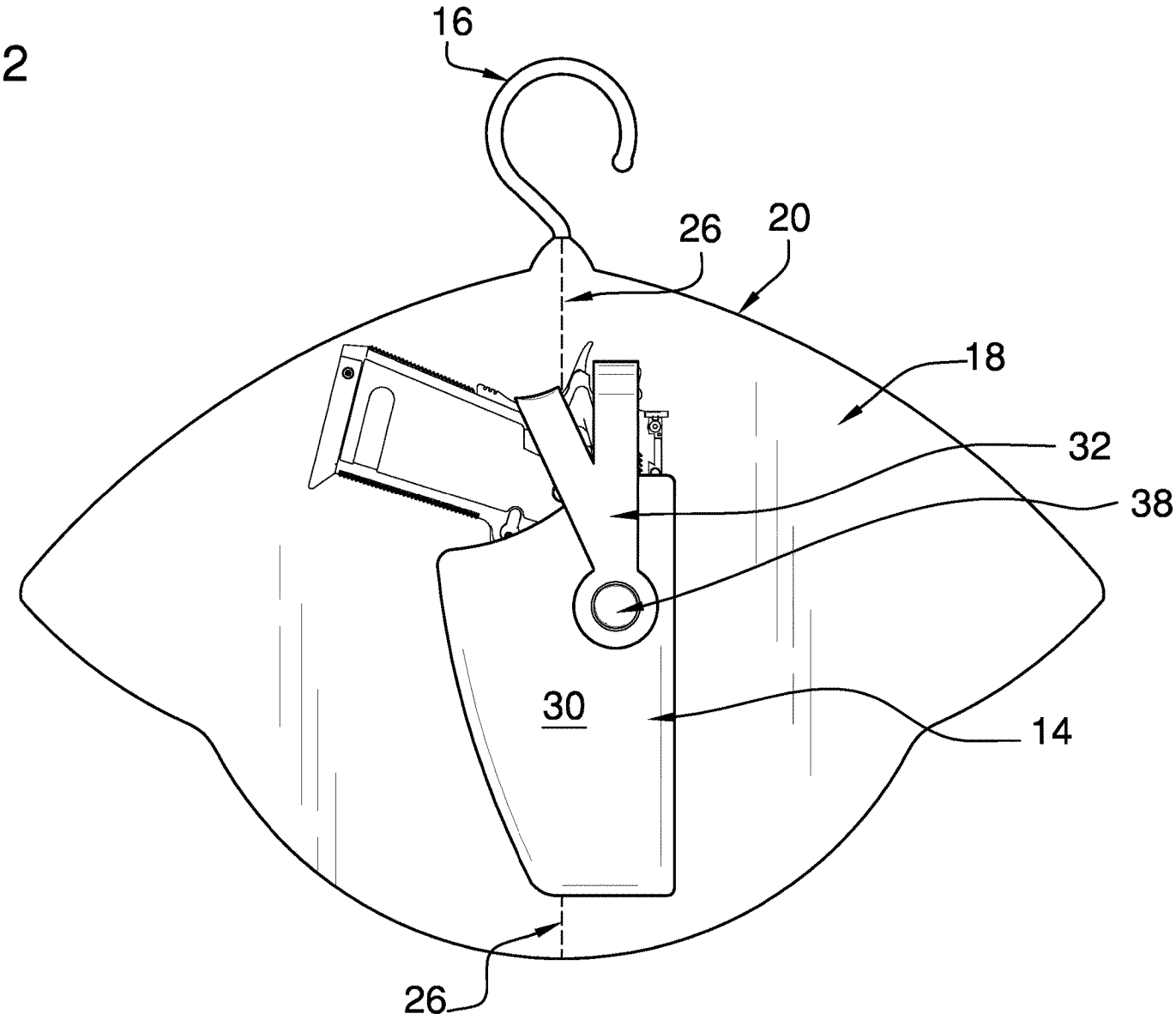
FIG. 2 is a front view of an embodiment of the disclosure.
Figure 6:
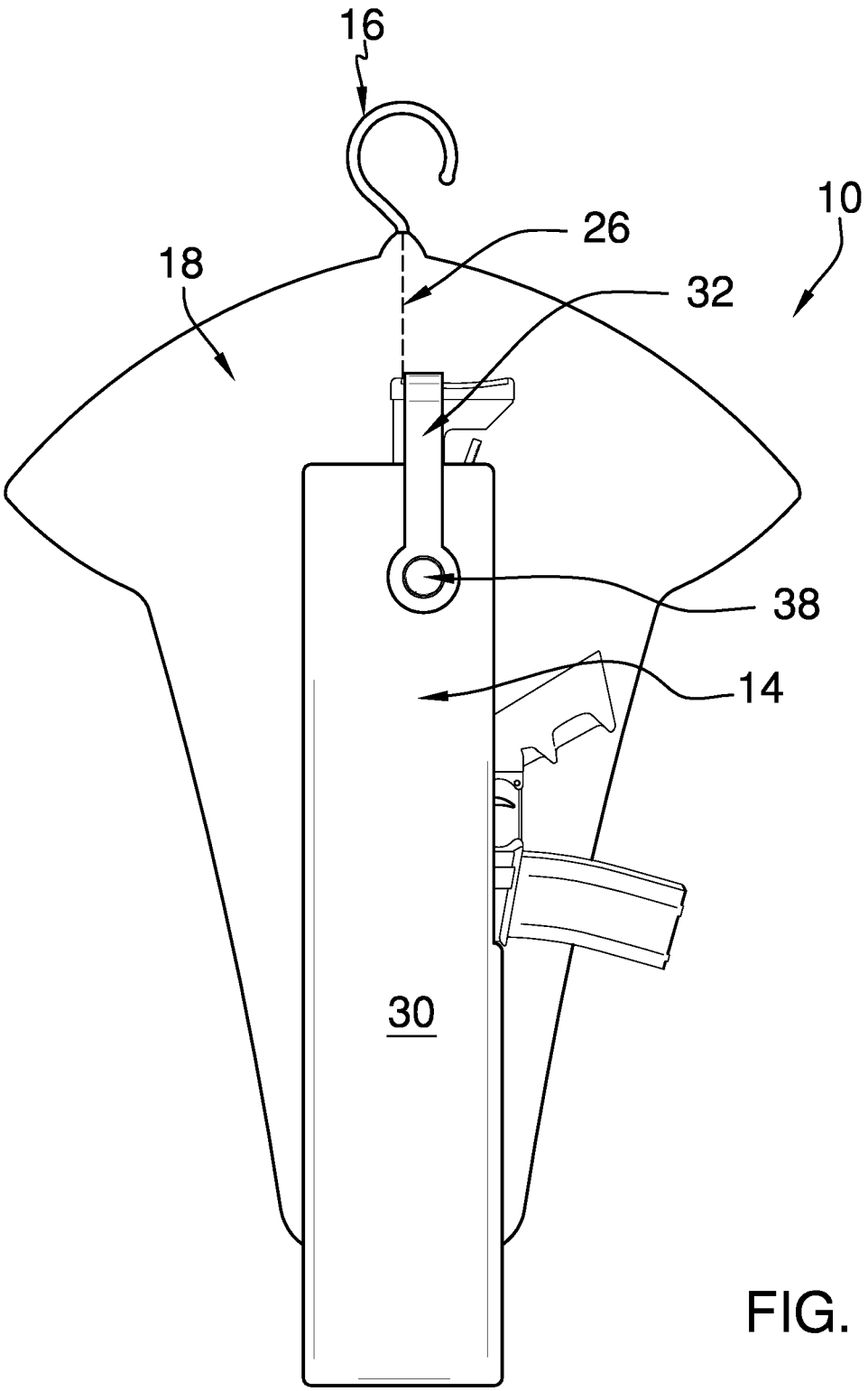
FIG. 6 is a front view of an embodiment of the disclosure.

The holster 14 is configured for insertion of a pistol, as shown in FIG. 2, or a rifle, as shown in FIG. 6. When the holster 14 is configured for insertion of a rifle, the panel 18 is elongated to complement a length of the rifle, as shown in FIG. 6. The holster 14 is positioned on the panel 18 such that, with the firearm inserted therein, a center of mass of the firearm is aligned with a centerline 26 of the panel 18. Therefore, the clothes hanger 12 is balanced upon the clothes rod. The holster 14 comprises fabric or leather. The holster 14 may comprise ballistic nylon.

Figure 3:
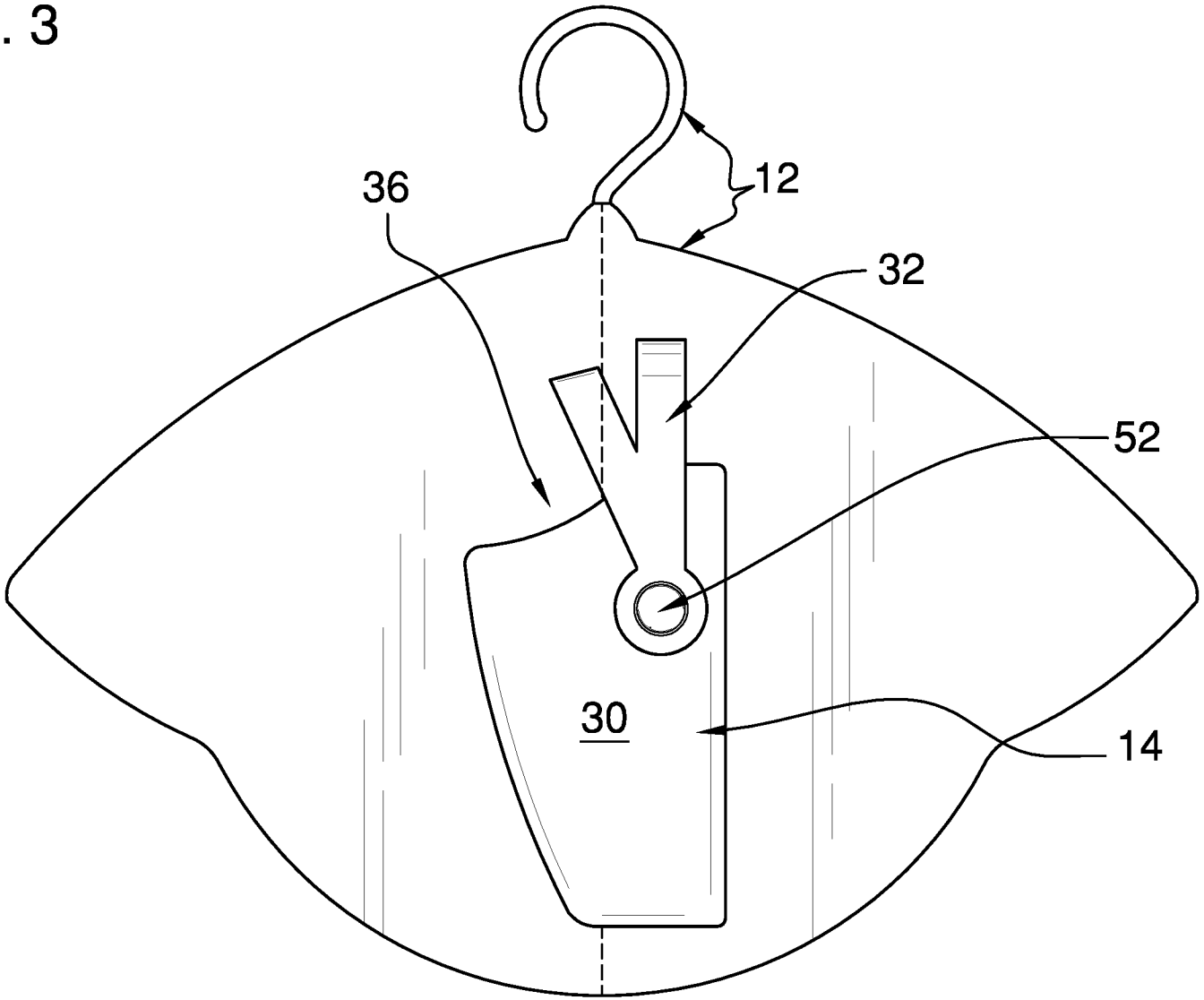
FIG. 3 is a back view of an embodiment of the disclosure.

A first fastener 28 is engaged to an outer face 30 of the holster 14. A strap 32 is engaged to the panel 18 between the holster 14 and the hook 16 and extends therefrom. A second fastener 34 is engaged to the strap 32 distal from the panel 18. The second fastener 34 is complementary to the first fastener 28 so that the second fastener 34 is positioned to selectively engage the first fastener 28 to fasten the strap 32 over an opening 36 of the holster 14 to secure the firearm therein. The strap 32 may comprise a pair of straps 32, as shown in FIGS. 1-3, with the second fastener 34 being engaged to each strap 32 of the two straps 32 distal from the panel 18. One of the straps 32 is configured for engaging a pistol grip of the firearm and the other of the straps 32 is configured for covering a hammer of the firearm.

Figure 5:
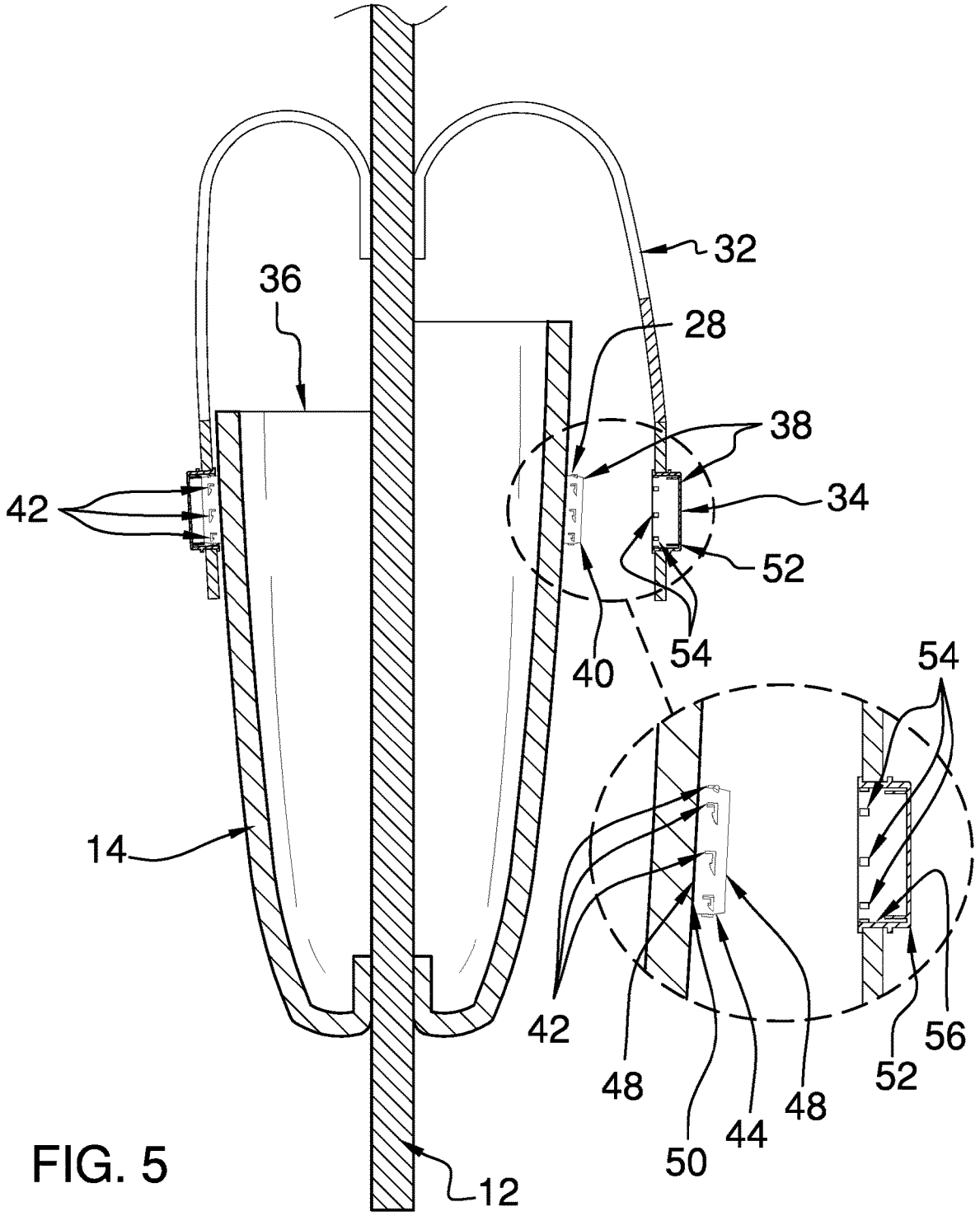
FIG. 5 is a cross-sectional view of an embodiment of the disclosure.

The second fastener 34 and the first fastener 28 comprise a child safety lock 38. For example, the first fastener 28 comprises a ring 40 and a set of first tabs 42, with the set of first tabs 42 being engaged to an outer circumference 44 of the ring 40 and extending circumferentially therearound, as shown in FIG. 5. Each first tab 42 is L-shaped and positioned substantially equally distant from an upper limit 46 and a lower limit 48 of the ring 40. The set of first tabs 42 and the outer face 30 of the holster 14 define a channel 50.

The second fastener 34 comprises a cap 52 and a set of second tabs 54, with the set of second tabs 54 being engaged to an inner perimeter 56 of the cap 52 and extending circumferentially therearound. The second tabs 54 engage the first tabs 42 when the cap 52 is pressed onto the ring 40 to lock the cap 52 to the ring 40. The cap 52 is configured to be pushed toward the panel 18 so that the set of second tabs 54 is positioned in the channel 50. The cap 52 thus is configured to be turned to disengage the cap 52 from the ring 40 to access the firearm in the holster 14. The present invention also anticipates other locking means for securing the strap 32 over the opening 36, such as, but not limited to, keyed locks, magnetic locks, biometric locks, and the like.

In use, a firearm is inserted into the holster 14 and secured therein by positioning the strap 32 over the opening 36 of the holster 14 and pressing the cap 52 onto the ring 40. A coat or jacket then is positioned on the clothes hanger 12 to conceal the firearm. The clothes hanger 12 is hung on the clothes rod using the hook 16. The child safety lock 38 deters access to the firearm by a child, while the inconspicuous positioning of the firearm in a closet conceals it from casual viewing and may deter theft. Access to the firearm is gained by pressing on and turning of the cap 52.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

We claim:

1. A firearm storage and safety device comprising:

a clothes hanger comprising a hook and a panel, the hook being engaged to and extending from an upper edge of the panel equally distant from opposed sides thereof, wherein the hook is configured for engaging a clothes rod for hanging the clothes hanger;

a holster engaged to a respective opposed face of the panel and being configured for insertion of a firearm, such that the firearm is engaged to the panel, wherein the clothes hanger is configured for hanging of an article of clothing thereupon for concealing the firearm;

a first fastener engaged to an outer face of the holster;

a strap engaged to the panel between the holster and the hook and extending therefrom;

a second fastener engaged to the strap distal from the panel, the second fastener being complementary to the first fastener, such that the second fastener is positioned for selectively engaging the first fastener for fastening the strap over an opening of the holster for securing the firearm therein, wherein the second fastener and the first fastener comprise a child safety lock;

wherein the first fastener comprises a ring and a set of first tabs, the set of first tabs being engaged to an outer circumference of the ring and extending circumferentially therearound, each first tab being L-shaped and positioned substantially equally distant from an upper limit and a lower limit of the ring, such that the set of first tabs and the outer face of the holster define a channel; and wherein the second fastener comprises a cap and a set of second tabs, the set of second tabs being engaged to an inner perimeter of the cap and extending circumferentially therearound, such that the second tabs engage the first tabs when the cap is pressed onto the ring for locking the cap to the ring, wherein the cap is configured for being pushed toward the panel, such that the set of second tabs is positioned in the channel, wherein the cap is configured for turning for disengaging the cap from the ring for accessing the firearm in the holster.

2. The firearm storage and safety device of claim 1, wherein the upper edge is arcuate such that the upper edge tapers downwardly from the hook to the opposed sides of the panel, wherein the clothes hanger is configured for hanging of a jacket or coat.

3. The firearm storage and safety device of claim 1, wherein the panel is substantially rigid.

4. The firearm storage and safety device of claim 3, wherein the panel comprises elastomer.

5. The firearm storage and safety device of claim 4, wherein the panel comprises acrylic-polyvinyl chloride.

6. The firearm storage and safety device of claim 1, wherein the holster is configured for insertion of a pistol or a rifle.

7. The firearm storage and safety device of claim 1, wherein the holster is one of a pair of holsters positioned singly on the opposed faces of the panel.

8. The firearm storage and safety device of claim 1, wherein the holster comprises fabric or leather.

9. The firearm storage and safety device of claim 1, wherein the holster comprises ballistic nylon.

10. The firearm storage and safety device of claim 1, wherein:

the strap comprise a pair of straps; and the second fastener being engaged to each strap of the two straps distal from the panel, Wherein one of the straps is configured for engaging a pistol grip of the firearm and the other of the straps is configured for covering a hammer of the firearm.

11. A firearm storage and safety device comprising:

a clothes hanger comprising a hook and a panel, the hook being engaged to and extending from an upper edge of the panel equally distant from opposed sides thereof, wherein the hook is configured for engaging a clothes rod for hanging the clothes hanger, the upper edge being arcuate such that the upper edge tapers downwardly from the hook to the opposed sides of the panel, wherein the clothes hanger is configured for hanging of a jacket or coat, the panel being substantially rigid, the panel comprising elastomer, the panel comprising acrylic-polyvinyl chloride;

a holster engaged to a respective opposed face of the panel and being configured for insertion of a firearm, such that the firearm is engaged to the panel, wherein the clothes hanger is configured for hanging of an article of clothing thereupon for concealing the firearm, the holster being configured for insertion of a pistol or a rifle, the holster being positioned on the panel such that, with the firearm inserted therein, a center of mass of the firearm is aligned with a centerline of the panel, such that the clothes hanger is balanced upon the clothes rod, the holster being one of a pair of holsters positioned singly on the opposed faces of the panel, the holster comprising fabric or leather, the holster comprising ballistic nylon;

a first fastener engaged to an outer face of the holster, the first fastener comprising a ring and a set of first tabs, the set of first tabs being engaged to an outer circumference of the ring and extending circumferentially therearound, each first tab being L-shaped and positioned substantially equally distant from an upper limit and a lower limit of the ring, such that the set of first tabs and the outer face of the holster define a channel;

a strap engaged to the panel between the holster and the hook and extending therefrom;

a second fastener engaged to the strap distal from the panel, the second fastener being complementary to the first fastener, such that the second fastener is positioned for selectively engaging the first fastener for fastening the strap over an opening of the holster for securing the firearm therein, the second fastener and the first fastener comprising a child safety lock, the second fastener comprising a cap and a set of second tabs, the set of second tabs being engaged to an inner perimeter of the cap and extending circumferentially therearound, such that the second tabs engage the first tabs when the cap is pressed onto the ring for locking the cap to the ring, wherein the cap is configured for being pushed toward the panel, such that the set of second tabs is positioned in the channel, wherein the cap is configured for turning for disengaging the cap from the ring for accessing the firearm in the holster; and the strap comprising a pair of straps, the second fastener being engaged to each strap of the two straps distal from the panel, wherein one of the straps is configured for engaging a pistol grip of the firearm and the other of the straps is configured for covering a hammer of the firearm.

* * * * *